US008242869B2

(12) United States Patent
Gruettner et al.

(10) Patent No.: US 8,242,869 B2
(45) Date of Patent: Aug. 14, 2012

(54) TRANSFORMER

(75) Inventors: Christian Gruettner, Ruethen (DE); Benjamin Weber, Winterberg (DE); Rudolf Schutzeichel, Ense (DE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 12/987,441

(22) Filed: Jan. 10, 2011

(65) Prior Publication Data

US 2011/0140821 A1 Jun. 16, 2011

Related U.S. Application Data

(63) Continuation of application No. PCT/EP2009/004120, filed on Jun. 9, 2009.

(30) Foreign Application Priority Data

Jul. 15, 2008 (DE) ..... 10 2008 033 125

(51) Int. Cl.
*H01F 27/08* (2006.01)

(52) U.S. Cl. ..... 336/60

(58) Field of Classification Search ..... 336/55–62, 336/220–223

See application file for complete search history.

(56) References Cited

U.S. PATENT DOCUMENTS

| | | | | |
|---|---|---|---|---|
| 2,710,947 | A * | 6/1955 | Gaston | 336/60 |
| 3,237,136 | A * | 2/1966 | Ford | 336/205 |
| 3,386,058 | A * | 5/1968 | Michel | 336/60 |
| 3,386,060 | A | 5/1968 | Hubert | |
| 3,431,524 | A * | 3/1969 | Broverman | 336/60 |
| 3,495,202 | A | 2/1970 | Parker | |
| 3,748,616 | A | 7/1973 | Weber et al. | |

FOREIGN PATENT DOCUMENTS

JP 4-010405 A 1/1992

OTHER PUBLICATIONS

International Search Report (PCT/ISA/210) issued on Aug. 21, 2009, by European Patent Office as the International Searching Authority for International Application No. PCT/EP2009/004120.

* cited by examiner

*Primary Examiner* — Tuyen Nguyen

(74) *Attorney, Agent, or Firm* — Buchanan Ingersoll & Rooney

(57) ABSTRACT

A transformer having a coil which is wound with conductor material and which contains cooling channels through which a cooling fluid flows is provided. The cooling channels are formed by corrugated components, the corrugation shape of which matches the outer surface, including the outer contour in corner regions of the coil.

6 Claims, 1 Drawing Sheet

TRANSFORMER

RELATED APPLICATIONS

This application claims priority as a continuation application under 35 U.S.C. §120 to PCT/EP2009/004120, which was filed as an International Application on Jun. 9, 2009 designating the U.S., and which claims priority to German Application 10 2008 033 125.2 filed in Germany on Jul. 15, 2008. The entire contents of these applications are hereby incorporated by reference in their entireties.

FIELD

The present disclosure is related to a transformer having a coil. More particularly, the present disclosure is related to a transformer having a coil which is wound with conductor material and which contains cooling channels through which a cooling fluid flows.

BACKGROUND INFORMATION

Particularly in the case of a circular coil, a corrugated component of this kind is wound around the component at the desired location, the individual corrugations being at essentially an even interval and having an even radial corrugation height, so that all the cooling channels have the same or essentially the same cross sections, so that cooling takes place evenly within the coil.

Corrugated components of this kind cannot be used if the coil portion intended to be wound or the coil section intended to be wound has a shape which is different from the circular shape, such as a rectangular shape, for example. Particularly in the case of the rectangular shape, even shaping of the corrugated component may result in a reduction in the radial height of the corrugation shape at the corners owing to the action of force, so that the cooling channels may be broken in this corner region and the flow cross sections do not have adequate values, which impairs the cooling in the region of the corners.

SUMMARY

An exemplary embodiment provides a transformer including a coil which is wound with conductor material and which includes corrugated components forming cooling channels through which a cooling fluid flows. A corrugation shape of the corrugation components matches an outer surface of the coil and an outer contour in corner regions of the coil.

An exemplary embodiment provides a transformer having an approximately quadrangular circumferential profile with planar regions and rounded corner regions. A corrugation length on the corner regions is small in comparison with a corrugation length on the planar regions.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Exemplary embodiments of the present disclosure provide a transformer having a coil which wound with conductor material and which contains cooling channels. The cooling channels are formed by means of corrugated components even when the circumferential contour of the coil differs significantly from a circular shape.

In accordance with an exemplary embodiment of the present disclosure, the cooling channels are formed by corrugated components, where the shape and number of corrugations of which matches the outer circumferential surface of the coil.

If corrugated components are used to produce the cooling channels for coils where the cross section of the coil is more or less quadrangular, the corrugation length of the individual corrugation shapes in the regions which are provided for the corner regions of the coil is significantly smaller than in the regions in which the outer circumferential contour of the coil is approximately straight or planar. Accordingly, in the region of the corners, a plurality of cooling channels are produced with a smaller cross section than in the planar regions, so that in the planar regions the number of cooling channels is smaller and the cross sections of the individual cooling channels are larger than in the region of the corners.

This arrangement can be used even if, instead of the planar surfaces, the circumferential contour contains regions with a large circumferential radius, which may be the case when a coil has an oval cross section, for example.

An undulate or corrugated component of this kind may be prefabricated in accordance with the circumferential contour of the coil, and the component may be a plastics component or else a conductor section, for example. The requisite shaping of the corrugated component can then be calculated in advance.

Figure 1:
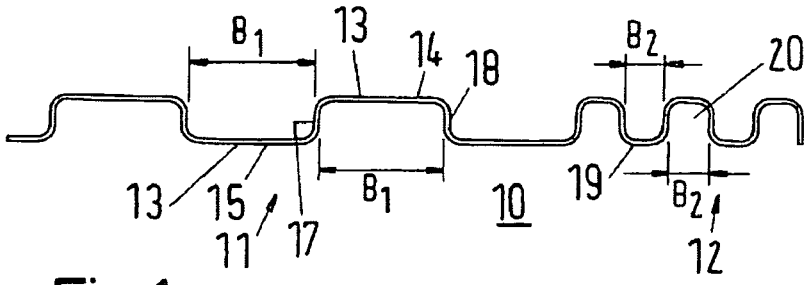
FIG. 1 shows a corrugated component according to an exemplary embodiment of the present disclosure.

FIG. 1 shows an exemplary embodiment of a corrugated component 10, which can also be called a wellboard. The corrugated component 10 has two respective sections 11 and 12 which respectively have a different corrugation shape from each other. In section 11, the individual corrugations 13 and 14 are flat, elongate corrugations with a corrugation length $B_1$. The individual corrugations 13 and 14 form corrugations with planar corrugation troughs 15 and complementary planar corrugation elevations 16 which are connected to one another by shoulders 17 and 18 which run perpendicular to the corrugation troughs 15 and the corrugation elevations 16.

The section 11 is joined by a section 12, in which the corrugation length of the corrugation troughs 19 and of the corrugation elevations 20 is $B_2$, which is significantly smaller than the width $B_1$. In accordance with an exemplary embodiment, $B_2$ can be approximately one-third $B_1$, for example.

Figure 2:
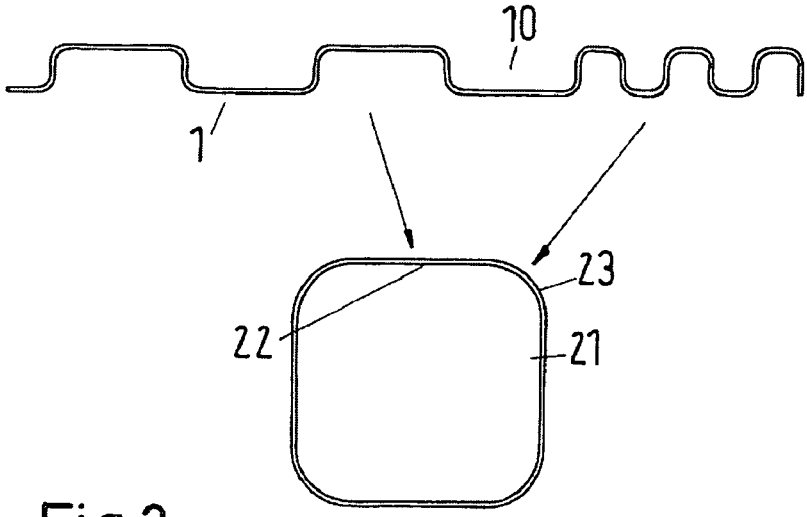
FIG. 2 shows an association between a corrugated component and a coil portion according to an exemplary embodiment of the present disclosure.

As illustrated in FIG. 2, the corrugated component 10 is applied to a coil shape 21 from the outside. The coil shape 21 has approximately a rectangular contour, with planar sections 22 and rounded corners 23.

Figure 3:
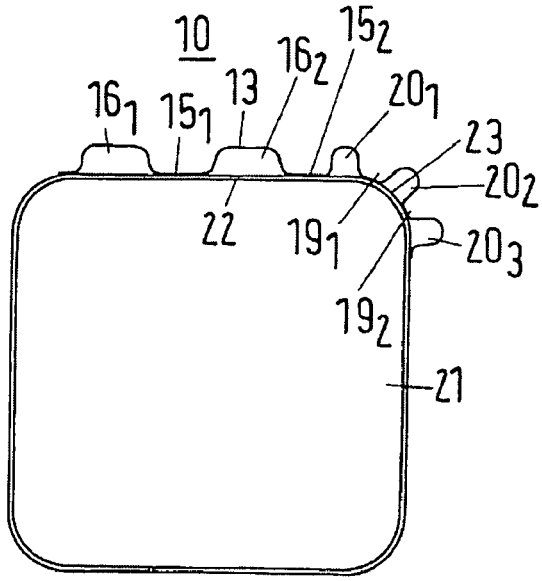
FIG. 3 shows a mounted corrugated component according to an exemplary embodiment of the present disclosure.

FIG. 3 shows an exemplary embodiment of the corrugated component 10 mounted on the coil 21. In the illustrated example, the region 22 contains two corrugation elevations $\mathbf{16}_1$ and $\mathbf{16}_2$, and the region of the rounded corner 23 contains three corrugation elevations $\mathbf{20}_1$, $\mathbf{20}_2$ and $\mathbf{20}_3$, between which there are situated the corrugation troughs $\mathbf{19}_1$, $\mathbf{19}_2$, which, like the corrugation troughs $\mathbf{15}_1$ and $\mathbf{15}_2$, are in contact with the outer surface of the coil 21.

The number, corrugation length and radial height of the corrugation elevations and corrugation troughs is dependent on the requisite cooling power. The number, corrugation length and radial height of the corrugation elevations and corrugation troughs can also be dependent on the circumferential contour of the coil 21.

The central axis of the coil 21 runs perpendicular to the plane of the drawing, so that the cross sections of the cooling channels, which cross sections are produced by the corrugation elevations and corrugation troughs, run parallel to the central longitudinal axis, that is to say in a vertical direction with respect to the illustrated example. The number of corrugation elevations $\mathbf{16}_1$, $\mathbf{16}_2$ then produces the same or approximately the same cooling cross section as the corrugation elevations $\mathbf{20}_1$, $\mathbf{20}_2$, $\mathbf{20}_3$ in the planar region 22 of the coil, so that the cooling in the planar region 22 is the same as the cooling in the region of the rounded corner.

A similar arrangement can be used even if the region 22 is formed by a circumferential contour with a large radius, or if the coil circumference 21 has an oval shape.

The exemplary embodiment of the corrugations with a different corrugation length ensures that the cross section of the air channels is even over the circumference. The requisite shaping of the corrugated component 10 can be calculated in advance, on the basis of the circumferential contour of the coil 21.

The aforementioned exemplary embodiments have been described with reference to a separately produced corrugated component 10. It is also possible for the conductor material with which the coil is to be wound to be produced in corrugated fashion as appropriate and then to be wound in a continuous process.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A transformer comprising:

a coil which is wound with conductor material and which includes corrugated components forming cooling channels through which a cooling fluid flows, wherein a corrugation shape of the corrugation components matches an outer surface of the coil and an outer contour in corner regions of the coil, wherein the coil has a circumferential profile differing from a circular shape, and wherein the number and shape of the corrugated components is proportioned on the basis of a circumferential radius of the coil such that the number of corrugated components on regions of the coil with a large circumferential radius is smaller than the number of corrugated components on regions of the coil with small circumferential radii.

2. A transformer having an approximately quadrangular circumferential profile with planar regions and rounded corner regions, wherein the transformer comprises:

a coil which is wound with conductor material and which includes corrugated components forming cooling channels through which a cooling fluid flows, wherein a corrugation shape of the corrugation components matches an outer surface of the coil corresponding to the planar regions of the transformer, and an outer contour in the rounded corner regions of the coil corresponding to the rounded corner regions of the transformer, wherein a corrugation length between corrugation components on the corner regions is smaller in comparison with a corrugation length between corrugation components on the planar regions.

3. The transformer as claimed claim 2, wherein the corrugation length in the corner regions is a fraction of the corrugation length in the planar regions.

4. The transformer as claimed claim 2, wherein the corrugation length in the corner regions is approximately one-third of the corrugation length in the planar regions.

5. The transformer as claimed in claim 4, wherein the number and shape of the corrugated components is proportioned on the basis of a circumferential radius of the coil such that the number of corrugated components on regions of the coil with a large circumferential radius is smaller than the number of corrugated components on regions of the coil with small circumferential radii.

6. The transformer as claimed in claim 1, wherein a corrugation length between the corrugation components on the corner regions is smaller in comparison with a corrugation length between corrugation components on planar regions of the coil.

* * * * *